US011255162B2

(12) United States Patent
Sullivan et al.

(10) Patent No.: US 11,255,162 B2
(45) Date of Patent: Feb. 22, 2022

(54) BULKHEAD ASSEMBLY FOR A TANDEM SUB, AND AN IMPROVED TANDEM SUB

(71) Applicant: XConnect, LLC, Denver, CO (US)

(72) Inventors: Shelby L. Sullivan, Minot, ND (US); Aaron Holmberg, Omaha, NE (US); Kelly Sullivan, Pengilly, MN (US)

(73) Assignee: XConnect, LLC, Denver, CO (US)

( * ) Notice: Subject to any disclaimer, the term of this patent is extended or adjusted under 35 U.S.C. 154(b) by 0 days.

(21) Appl. No.: 17/164,531

(22) Filed: Feb. 1, 2021

(65) Prior Publication Data

US 2021/0156231 A1 May 27, 2021

Related U.S. Application Data

(63) Continuation-in-part of application No. 16/836,193, filed on Mar. 31, 2020, now Pat. No. 10,914,145.

(60) Provisional application No. 62/845,692, filed on May 9, 2019, provisional application No. 62/827,403, filed on Apr. 1, 2019.

(51) Int. Cl.
*E21B 43/1185* (2006.01)
*E21B 41/00* (2006.01)

(52) U.S. Cl.
CPC ..... *E21B 41/00* (2013.01); *E21B 43/1185* (2013.01)

(58) Field of Classification Search
None
See application file for complete search history.

(56) References Cited

U.S. PATENT DOCUMENTS 2,029,490 A 2/1936 Lane
2,062,974 A 12/1936 Lane
2,264,450 A 12/1941 Mounce
2,331,058 A 10/1943 Stick, Jr.
2,621,732 A 12/1952 Ahlgren
3,032,107 A 5/1962 Rumble et al.
3,126,964 A 3/1964 La Rue
3,528,511 A 9/1970 Boop et al.
(Continued)

FOREIGN PATENT DOCUMENTS

CA 2985242 A1 5/2018

OTHER PUBLICATIONS

GEODynamics' EPIC™ Switches Brochure; GEODynamics; Copyright 2020; v.03; 1 page.
(Continued)

*Primary Examiner* — Reginald S Tillman, Jr.
(74) *Attorney, Agent, or Firm* — Peter L. Brewer; Thrive IP

(57) ABSTRACT

A bulkhead assembly for transmitting current to a downhole tool such as a perforating gun. The bulkhead assembly comprises a tubular bulkhead body having a bore therein. The bulkhead assembly also includes an electrical contact pin. The contact pin comprises a shaft having a first end and a second end. The shaft is fabricated substantially from brass and comprises a plurality of grooves. At the same time, the bore comprises a profile for mating with and receiving the plurality of grooves. This grooved, mating arrangement increases shear strength of the bulkhead assembly. Preferably, a first end of the electrical contact pin is in electrical communication with a wire within a wellbore. The wire transmits electrical signals from an operator at the surface. The shaft comprises a conical portion proximate the first end that frictionally fits into a mating conical profile of the bore. A tandem sub having an improved electrical communication is also provided herein.

12 Claims, 13 Drawing Sheets

(56) References Cited

U.S. PATENT DOCUMENTS

| | | | |
|---|---|---|---|
| 3,648,785 | A | 3/1972 | Walker |
| 3,695,368 | A | 10/1972 | Lanmon, II |
| 3,945,322 | A | 3/1976 | Carlson et al. |
| 4,164,886 | A | 8/1979 | Hallmark |
| 4,759,291 | A | 7/1988 | Barker et al. |
| 4,790,383 | A | 12/1988 | Savage et al. |
| 5,042,594 | A | 8/1991 | Gonzalez et al. |
| 5,355,802 | A | 10/1994 | Petitjean et al. |
| 5,571,986 | A | 11/1996 | Snider et al. |
| 6,658,981 | B2 | 12/2003 | Rochen et al. |
| 7,364,451 | B2 | 4/2008 | Ring et al. |
| 7,565,927 | B2 | 7/2009 | Gerez et al. |
| 7,591,212 | B2 | 9/2009 | Myers, Jr. et al. |
| 7,902,469 | B2 | 3/2011 | Hurst |
| 7,913,603 | B2 | 3/2011 | LaGrange et al. |
| 7,980,309 | B2 | 7/2011 | Crawford et al. |
| 8,074,737 | B2 | 12/2011 | Hill et al. |
| 8,256,337 | B2 | 9/2012 | Hill et al. |
| 8,369,063 | B2 | 2/2013 | Vicente et al. |
| 8,395,878 | B2 | 3/2013 | Stewart et al. |
| 8,597,979 | B1 | 12/2013 | Burgyan |
| 8,844,127 | B2 | 9/2014 | Finke et al. |
| 8,875,787 | B2 | 11/2014 | Tassaroli |
| 9,080,433 | B2 | 7/2015 | Lanclos et al. |
| 9,145,764 | B2 | 9/2015 | Burton et al. |
| 9,518,454 | B2 | 12/2016 | Current et al. |
| 9,530,581 | B2 | 12/2016 | Bonavides et al. |
| 9,581,422 | B2 | 2/2017 | Preiss et al. |
| 9,759,049 | B2 | 9/2017 | Hardesty et al. |
| 9,835,015 | B2 | 12/2017 | Hardesty et al. |
| 9,845,666 | B2 | 12/2017 | Hardesty et al. |
| 10,066,921 | B2 | 9/2018 | Eitschberger |
| 10,184,331 | B2 | 1/2019 | Mace et al. |
| 10,188,990 | B2 | 1/2019 | Burmeister et al. |
| 10,273,788 | B2 | 4/2019 | Bradley et al. |
| 10,287,866 | B2 | 5/2019 | Angman et al. |
| 10,352,136 | B2 | 7/2019 | Goyeneche |
| 10,352,674 | B2 | 7/2019 | Eitschberger et al. |
| 10,365,078 | B2 | 7/2019 | Eitschberger et al. |
| 10,386,168 | B1 | 8/2019 | Preiss et al. |
| 10,408,024 | B2 | 9/2019 | Hardesty et al. |
| 10,458,213 | B1 | 10/2019 | Eitschberger et al. |
| 10,465,462 | B2 | 11/2019 | Frazier et al. |
| 10,472,938 | B2 | 11/2019 | Parks et al. |
| 10,502,036 | B2 | 12/2019 | Spring et al. |
| 10,507,433 | B2 | 12/2019 | Eitschberger et al. |
| 10,519,733 | B2 | 12/2019 | Rosenthal et al. |
| 10,519,754 | B2 | 12/2019 | Prisbell et al. |
| 10,584,950 | B2 | 3/2020 | Saltarelli et al. |
| 10,597,979 | B1 | 3/2020 | Eitschberger et al. |
| 10,641,068 | B2 | 5/2020 | Hardesty et al. |
| 10,662,750 | B2 | 5/2020 | Angman et al. |
| 10,669,821 | B2 | 6/2020 | Knight et al. |
| 10,677,026 | B2 | 6/2020 | Kondou et al. |
| 10,689,955 | B1 | 6/2020 | Mauldin et al. |
| 10,731,444 | B2 | 8/2020 | Wells et al. |
| 10,731,445 | B2 | 8/2020 | Akkerman et al. |
| 10,731,955 | B2 | 8/2020 | Baum et al. |
| 10,844,697 | B2 | 11/2020 | Preiss et al. |
| 10,900,334 | B2 | 1/2021 | Knight et al. |
| 10,900,335 | B2 | 1/2021 | Knight et al. |
| 2011/0271823 | A1 | 11/2011 | Vicente |
| 2012/0199352 | A1 | 8/2012 | Lanclos et al. |
| 2012/0247769 | A1 | 10/2012 | Schacherer et al. |
| 2013/0126237 | A1 | 5/2013 | Burton et al. |
| 2014/0338552 | A1 | 11/2014 | Mace et al. |
| 2015/0000509 | A1 | 1/2015 | Current et al. |
| 2018/0135389 | A1 | 5/2018 | Sullivan |

OTHER PUBLICATIONS

Josh Howk and Adam Dyess; "Mitigating the Problems in Select-Fire Perforating Operations" IPS 16-22; 2016 International Perforating Symposium Galveston; May 10, 2016; 15 pages.

Hunting Titan Brochure; Hunting Energy Services; Copyright 2020; v.9.1; 27 pages.

Screen Shot of CircuPool Flow Switch Housing(R); https://www.circupool.com/CircuPool%C2%AE-Flow-Switch-Housing_p_237.html; 2 pages.

Screen Shot of Chaparral Performance Machine Contour FL Right Side 5 Button Switch Housing; https://www.chapmoto.com/performance-machine-contour-fl-right-side-5-button-switch-housing-parent-397-pm3081; 2 pages.

Screen shot of OsoLite® Lite'n Your Workload with Oso's Prewired, Disposable Perforating Gun System; https://www.osoperf.com/perf-hardware/osolite; Date of access of Feb. 1, 2021; 2 pages.

Screen shot of SWM International Inc. Thunder Disposable Gun System; https://web.archive.org/web/20200109183633/http:/swmtx.com/pdf/thunder_gun.pdf; Date of access of Feb. 1, 2021; 5 pages.

Screen shot of Yellow Jacket Oil Tools: Perforating Guns; https://www.yjoiltools.com/perforating-guns; Date of access of Feb. 1, 2021; 1 page.

Screen shot of Nexus Perforating: Double Nexus Connect (Thunder Gun System); https://www.yjoiltools.com/perforating-guns; Date of access of Feb. 1, 2021; 1 page.

Screen shot of Vigor USA: Perforating Gun Accessories—Economical and Dependable Perforating Gun Accessories; https://vigorusa.com/perforating-gun-accessories/; Date of access of Feb. 1, 2021; 2 page.

Screen shot of Yellow Jacket Oil Tools: Pre-Wired Perforating Gun; https://www.yjoiltools.com/Perforating-Guns/Pre-Wired-Perforating-Gun; Date of access of Feb. 1, 2021; 1 page.

Screen shot of GR Energy Services—ZipFire™ ReFrac gun system; https://www.grenergyservices.com/zipfire-refrac/Date of access of Feb. 1, 2021; 2 pages.

Screen shot of GR Energy Services—ZipFire™ high-efficiency perforating system answers current completion demands for higher stage-per-day performance; https://www.grenergyservices.com/zipfire/; date of access of Feb. 1, 2021; 2 pages.

Screen shot of Rock Faithwell—Perforating Gun System; http://www.cnrock.com.cn/h-col-116.html; date of access of Feb. 1, 2021; 2 pages.

Screen shot of APT American—Perforating Guns; https://aptamerican.com/perforating-guns; date of access of Feb. 1, 2021; 1 page.

Screen shot of NexTier—Innovative Solutions: GameChanger™ Perforating System; https://nextierofs.com/solutions/innovative-solutions/gamechanger/; date of access of Feb. 1, 2021; 2 pages.

BULKHEAD ASSEMBLY FOR A TANDEM SUB, AND AN IMPROVED TANDEM SUB

CROSS REFERENCE TO RELATED APPLICATIONS

This application is filed as a Continuation-in-Part of U.S. Ser. No. 16/836,193 filed Mar. 31, 2020. That application is entitled "A Bulkhead Assembly for a Tandem Sub, and an Improved Tandem Sub."

The '193 application claimed the benefit of U.S. Ser. No. 62/827,403 filed Apr. 1, 2019. That application is entitled "A Bulkhead Assembly for a Tandem Sub, and an Improved Tandem Sub."

The '193 application also claimed the benefit of U.S. Ser. No. 62/845,692 filed May 9, 2019. That application is entitled "Bulkhead Assembly for Downhole Perforating Tool."

Each of these applications is incorporated herein by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the invention relates to a tandem sub used to mechanically and electrically connect perforating guns along a perforating gun assembly. The invention also pertains to a bulkhead assembly and contact pin used to transmit detonation signals from the surface to a perforating gun downhole.

TECHNOLOGY IN THE FIELD OF THE INVENTION

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation of aquitards and hydrocarbon-producing zones behind the casing.

In connection with the completion of the wellbore, several strings of casing having progressively smaller outer diameters will be cemented into the wellbore. These will include a string of surface casing, one or more strings of intermediate casing, and finally a production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to economically "kick-off" and steer wellbore trajectories from a generally vertical orientation to a generally horizontal orientation. The horizontal "leg" of each of these wellbores now often exceeds a length of one mile, and sometimes two or even three miles. This significantly multiplies the wellbore exposure to a target hydrocarbon-bearing formation (or "pay zone"). The horizontal leg will typically include the production casing.

FIG. 1 is a side, cross-sectional view of a wellbore 100, in one embodiment. The wellbore 100 defines a bore 10 that has been drilled from an earth surface 105 into a subsurface 110. The wellbore 100 is formed using any known drilling mechanism, but preferably using a land-based rig or an offshore drilling rig operating on a platform.

The wellbore 100 is completed with a first string of casing 120, sometimes referred to as surface casing. The wellbore 100 is further completed with a second string of casing 130, typically referred to as an intermediate casing. In deeper wells, that is wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. The wellbore is completed horizontally, meaning that a horizontal "leg" 156 is provided. The production casing 150 will also extend along the horizontal leg 156.

It is observed that the annular region around the surface casing 120 is filled with cement 125. The cement (or cement matrix) 125 serves to isolate the wellbore from fresh water zones and potentially porous formations around the casing string 120.

The annular regions around the intermediate casing strings 130, 140 are also filled with cement 135, 145. Similarly, the annular region around the production casing 150 is filled with cement 155. However, the cement 135, 145, 155 is optionally only placed behind the respective casing strings 130, 140, 150 up to the lowest joints of the immediately surrounding casing strings. Thus, for example, a non-cemented annular area 132 may be preserved above the cement matrix 135, a non-centered annular area 142 may optionally be preserved above the cement matrix 145, and a non-cemented annular area 152 is frequently preserved above the cement matrix 155.

The horizontal leg 156 of the wellbore 100 includes a heel 153 and a toe 154. In this instance, the toe 154 defines the end (or "ID") of the wellbore 100. In order to enhance the recovery of hydrocarbons, particularly in low-permeability formations 115, the casing 150 along the horizontal section 156 undergoes a process of perforating and fracturing (or in some cases perforating and acidizing). Due to the very long lengths of new horizontal wells, the perforating and formation treatment process is typically carried out in stages.

In one method, a perforating gun assembly (shown schematically at 200) is pumped down towards the end of the horizontal leg 156 at the end of a wireline 240. The perforating gun assembly 200 will include a series of perforating guns (shown at 210 in FIG. 2), with each gun having sets of charges ready for detonation. A plug setting tool 160 is placed at the end of the perforating gun assembly 200.

After the perforating gun assembly 200 is pumped down to a desired depth, the charges associated with one of the perforating guns are detonated and perforations are "shot" into the casing 150. Those of ordinary skill in the art will understand that a perforating gun has explosive charges, typically shaped, hollow or projectile charges, which are ignited to create holes in the casing (and, if present, the surrounding cement) 150 and to pass at least a few inches and possibly several feet into the formation 115. The perforations (not shown) create fluid communication with the surrounding formation 115 (or pay zone) so that hydrocarbons can flow into the casing 150.

After perforating, the operator will fracture (or otherwise stimulate) the formation 115 through the perforations. This is done by pumping treatment fluids into the formation 115 at a pressure above a formation parting pressure. After the fracturing operation is complete, the wireline 240 will be raised and the perforating gun assembly 200 will be positioned at a new location (or "depth") along the horizontal wellbore 156. A plug (such as plug 112) is set below the perforating gun assembly 200 using the setting tool 160, and new shots are fired in order to create a new set of perforations (not shown). Thereafter, treatment fluid is again pumped into the wellbore 100 and into the formation 115 at a pressure above the formation parting pressure. In this way, a second set (or "cluster") of fractures is formed away from the wellbore 156.

The process of setting a plug, perforating the casing, and fracturing the formation is repeated in multiple stages until the wellbore has been completed, that is, it is ready for production. A string of production tubing (not shown) is then placed in the wellbore to provide a conduit for production fluids to flow up to the surface 105.

In order to provide perforations for the multiple stages without having to pull the perforating gun after every detonation, the perforating gun assembly 200 employs multiple guns in series. FIG. 2 is a side view of an illustrative perforating gun assembly 200, or at least a portion of the assembly. The perforating gun assembly 200 comprises a string of perforating guns 210.

Each perforating gun 210 represents various components. These typically include a "gun barrel" 212 which serves as an outer tubular housing. An uppermost gun barrel 212 is supported by an electric wire (or "e-line") 240 that extends from the surface and that delivers electrical energy down to the tool string 200. Each perforating gun 210 also includes an explosive initiator, or "detonator" (not shown). The detonator is typically a small aluminum housing having a resistor inside. The detonator receives electrical energy from the surface 105 and through the e-line 240, which heats the resistor.

The detonator is surrounded by a sensitive explosive material such as RDX. When current is run through the detonator, a small explosion is set off by the electrically heated resistor. Stated another way, the explosive compound is ignited by the detonator. This small explosion sets off and adjacent detonating cord. When ignited, the detonating cord initiates one or more shots, typically referred to as "shaped charges." The shaped charges (shown at 520 in FIG. 5) are held in an inner tube (shown at 500 in FIG. 5), referred to as a carrier tube, for security and discharged through openings 215 in the selected gun barrel 212. As the RDX is ignited, the detonating cord delivers the explosion to the shaped charges along the first perforating gun.

The perforating gun assembly 200 may include short centralizer subs 220. In addition, tandem subs 225 are used to connect the gun barrels 212 end-to-end. Each tandem sub 225 comprises a metal threaded connector placed between the gun barrels 212. Typically, the gun barrels 212 will have female-by-female threaded ends while the tandem sub 225 has opposing male threaded ends.

An insulated connection member 230 connects the e-line 240 to the uppermost perforating gun 210. The perforating gun assembly 200 with its long string of gun barrels (the housings 212 of the perforating guns 210) is carefully assembled at the surface 105, and then lowered into the wellbore 10 at the end of the e-line 240 and connection member 230. The e-line 240 extends upward to a control interface (not shown) located at the surface 105. An operator of the control interface may send electrical signals to the perforating gun assembly 200 for detonating the shaped charges through the openings and for creating the perforations in the casing 150.

After the casing 150 has been perforated and at least one plug 112 has been set, the setting tool 160 and the perforating gun assembly 200 are taken out of the well 100 and a ball (not shown) is dropped into the wellbore 100 to close the plug 112. When the plug 112 is closed, a fluid, (e.g., water, water and sand, fracturing fluid, etc.) is pumped by a pumping system (not shown), down the wellbore 100 for fracturing purposes.

As noted, the above operations may be repeated multiple times for perforating and/or fracturing the casing 150 at multiple locations, corresponding to different stages of the well. Multiple plugs may be used for isolating the respective stages from each other during the perforating phase and/or fracturing phase. When all stages are completed, the plugs are drilled out and the wellbore is cleaned using a circulating tool.

It can be appreciated that a reliable electrical connection must be made between the gun barrels 210 in the tool string 200 through each tandem sub 225. Currently, electrical connections are made using either a percussion switch that has leads soldered on both ends, or a bulkhead that also has leads soldered on both ends. The use of soldered leads at each end adds work during the assembly process and creates what can sometimes be an uncertain electrical connection.

In addition to the soldering step, current assembly operations require that a communication wire be stripped by hand and then manually wrapped onto a contact pin. An insulation tubing is then manually installed over the contact pin to retain the electrical connection.

FIG. 3 demonstrates a known bulkhead 300 (sometimes referred to as a "bulkhead assembly") having a contact pin 320. Specifically, FIG. 3 offers a side, plan view of the bulkhead 300. The bulkhead 300 defines a body 310 having a generally circular profile. The body 300 has a first, or upstream end 312 and a second, or downstream end 314. However, these orientations may be reversed.

A pair of circular grooves is formed along the body 310 of the bulkhead 300. The grooves are configured to receive respective o-rings 322. The o-rings 322 preferably define elastomeric seals that closely fit between an outer diameter of the body 310 and a surrounding bulkhead receptacle within a tandem sub, such as subs 225.

The contact pin 320 extends through an inner bore (not shown) of the bulkhead 300. The contact pin 320 defines an elongated body 325 that is fabricated from an electrically conductive material. The contact pin 320 includes a contact head 321 that is in contact with an electrical detonator head within the gun barrel 210.

The bulkhead 300 is designed to be in electrical communication with an electrical wire 330. In FIG. 3, a portion of the wire 330 is shown in contact with a bulkhead connector 332. The wire 330 is in communication with insulated e-line 240 and receives detonation signals from the surface. A portion of an insulated cover is shown at 335.

The bulkhead 300 serves to relay the detonation (or initiation) signals to the detonator head (not shown). In operation, the operator will send a signal from the surface, down the e-line (such as e-line 240 of FIG. 2), through wire 330, through the body 325 of the pin 320, to the contact head 321, and into a downstream gun barrel 210. From there, a detonation signal is received by on-board electronics and charges are detonated into the surrounding casing as discussed above. Where a series of gun barrels is used in a gun assembly, the signal from the wireline 330 will be transmitted through a series of gun barrels and a series of corresponding bulkhead assemblies 300 to the perforating guns 210 intended to be activated.

Because of the high pressure and high temperature environment that a gun barrel assembly experiences downhole, the bulkhead 300 is frequently fabricated from expensive and heavy metal materials. Therefore, a need exists for a bulkhead design that may be fabricated from a less expensive material while retaining sufficient strength. Further, a need exists for a bulkhead assembly wherein interlocking grooves are provided as between the electrical contact pin and the bulkhead body to increase shear strength of the bulkhead. Finally, a need exists for an improved electrical connection between the contact pin and a signal transmission pins that are inserted as male members into opposing female ends of the contact pin.

BRIEF SUMMARY OF THE INVENTION

A bulkhead assembly for transmitting current to a downhole tool is provided herein. Preferably, the downhole tool is a perforating gun though the downhole tool may alternatively be a logging tool. Preferably, the bulkhead assembly resides within a tandem sub between perforating guns.

In one embodiment, the bulkhead assembly first comprises a tubular bulkhead body. The bulkhead body has a first end, a second end, and a bore extending there between. Preferably, the bulkhead body is fabricated from a non-conductive material such as plastic (poly-carbonate) or nylon.

The bulkhead assembly further comprises an electrical contact pin. The contact pin comprises a shaft having a first end and a second end. Of interest, the shaft resides entirely within the bore of the bulkhead body. The contact pin is fabricated from an electrically conductive material for transmitting current from the second (or upstream) end down to the first (or downstream) end. Preferably, the conductive material is brass, or a metal alloy comprised substantially of brass.

The first end of the electrical contact pin defines an opening configured to receive a first signal transmission pin. The first signal transmission pin, in turn, is in electrical communication with a communications wire that extends downstream from the bulkhead assembly, to transmit electrical signals to an adjoining tool downhole. Preferably, the signal is sent to an addressable switch that is part of an electrical assembly. Preferably the communications wire is not in electrical communication with a detonator, meaning the addressable switch prevents current from passing to a detonator to be activated, but sends an entirely separate signal to the detonator if and only if the addressable switch recognizes an activation command.

The second end of the contact pin also defines an opening, which is configured to receive a second signal transmission pin. The second end of the contact pin is in electrical communication with an electric line within a wellbore from upstream of the tandem sub, by means of the second signal transmission pin. The electric line transmits electrical signals to the second signal transmission pit from a surface. It is understood that the electric line may include a plurality of lines passing through upstream perforating guns and signal transmission pins.

Of interest, the shaft of the electrical contact pin comprises a plurality of grooves. At the same time, the bore of the bulkhead body comprises a profile for mating with the plurality of grooves. This grooved, mating arrangement increases the shear strength of the bulkhead assembly. In one embodiment, the plurality of grooves comprises at least three grooves equi-distantly spaced along the shaft. More preferably, at least five grooves are provided.

In one aspect, the shaft comprises a frusto-conical portion proximate the first end. The frusto-conical portion frictionally fits into a mating conical profile of the receptacle. The grooves of the electrical contact pin closely fit into the mating profile of the bulkhead body to inhibit relative rotation.

An improved tandem sub is also provided herein. The tandem sub includes a first end and an opposing second end. The first end comprises a male connector that is threadedly connected to a first perforating gun. At the same time, the second end comprises a male connector that is threadedly connected to a second perforating gun.

Each perforating gun preferably represents a carrier tube carrying charges. The carrier tube and charges, in turn, reside within a tubular gun barrel housing. Each gun barrel housing comprises opposing female threads for connecting to a respective end of the tandem sub.

The tandem sub also includes a receptacle. The receptacle resides within a bore of the tandem sub. The receptacle is dimensioned to closely receive a bulkhead assembly. The bulkhead assembly is arranged to accordance with the bulkhead assembly described above, in its various embodiments. For instance, the bulkhead assembly may include:

- a tubular body having a first end, a second end and a cavity extending there between;
- an electrical contact pin having an elongated shaft residing entirely within the cavity of the bulkhead body and having a first end and a second end, and wherein the electrical contact pin is fabricated from an electrically conductive material for transmitting current from the second (or upstream) end to the first (or downstream) end;

and wherein

- the first end of the contact pin defines an opening configured to receive a first signal transmission pin,
- the first end of the contact pin is configured to be in electrical communication with a communications wire that extends downstream from the bulkhead assembly, to transmit electrical signals to an adjoining tool,
- the second end of the contact pin also defines an opening, and is configured to receive a second signal transmission pin,
- the second end of the contact pin is configured to be in electrical communication with an electric line within a wellbore from upstream of the bulkhead assembly, by means of the second signal transmission pin, and the electric line transmits electrical signals to the second signal transmission pin from a surface.

Preferably, the shaft of the electrical contact pin comprises a plurality of grooves, while the bore comprises a profile for mating with the plurality of grooves. This provides increased shear strength for the bulkhead assembly.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Reference herein to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

Description of Selected Specific Embodiments

Figure 1:
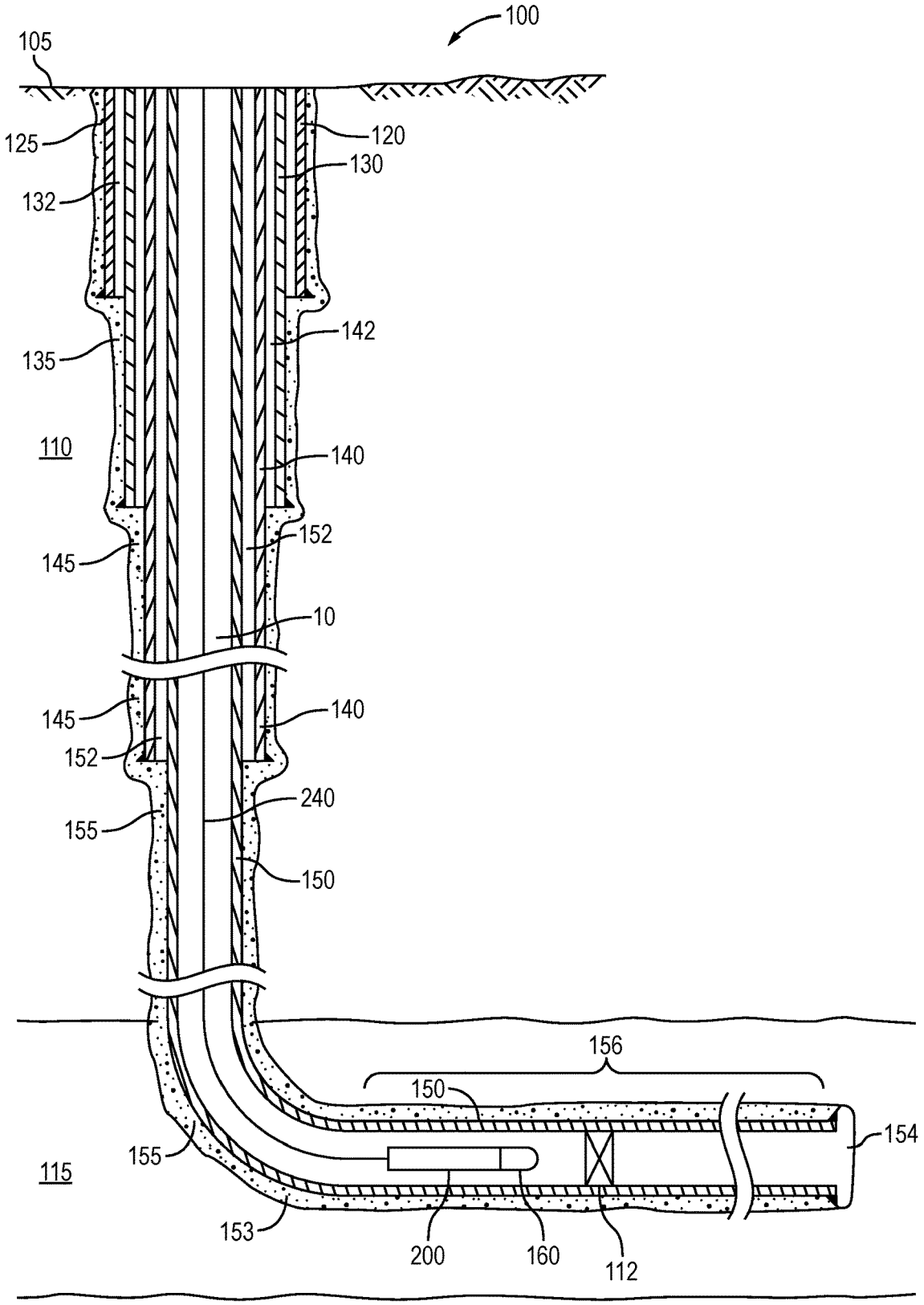
FIG. 1 (Prior Art)
FIG. 1 is a side, cross-sectional view of an illustrative wellbore. The wellbore is being completed with a horizontal leg. A perforating gun assembly is shown having been pumped into the horizontal leg.
Figure 2:
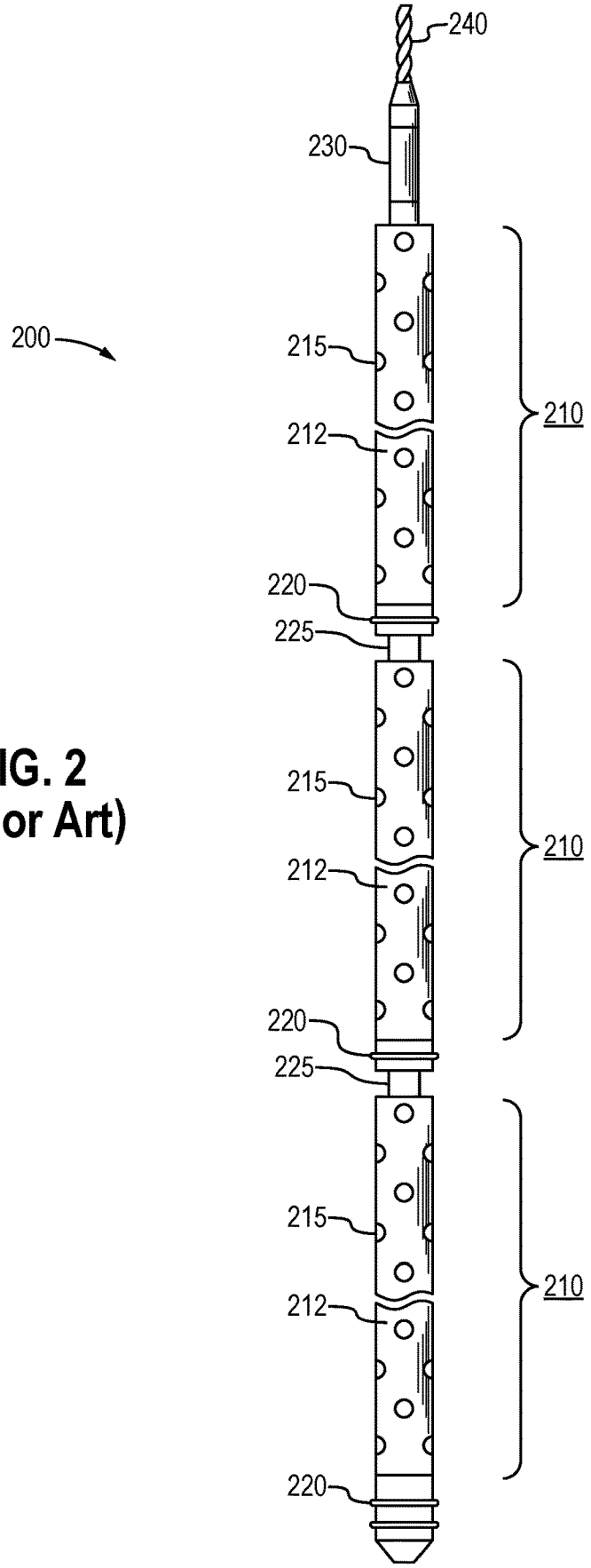
FIG. 2 (Prior Art)
FIG. 2 is a side, plan view of a known perforating gun assembly. In this view, a series of perforating guns is shown, spaced apart through the use of connecting tandem subs.
Figure 3:
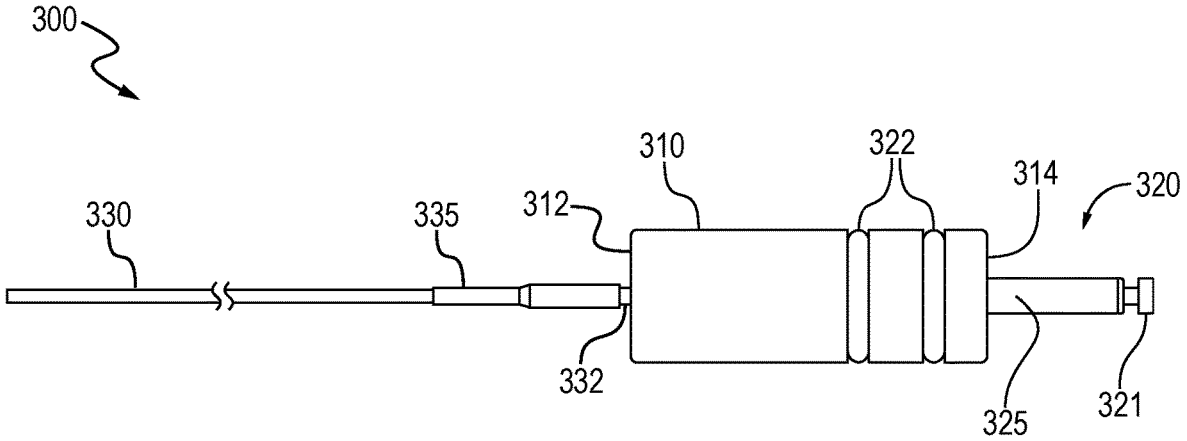
FIG. 3 (Prior Art)
FIG. 3 is a side, plan view of a known bulkhead assembly. In this view, an electrical wire is connected to an upstream end of the bulkhead assembly.
Figure 4A:
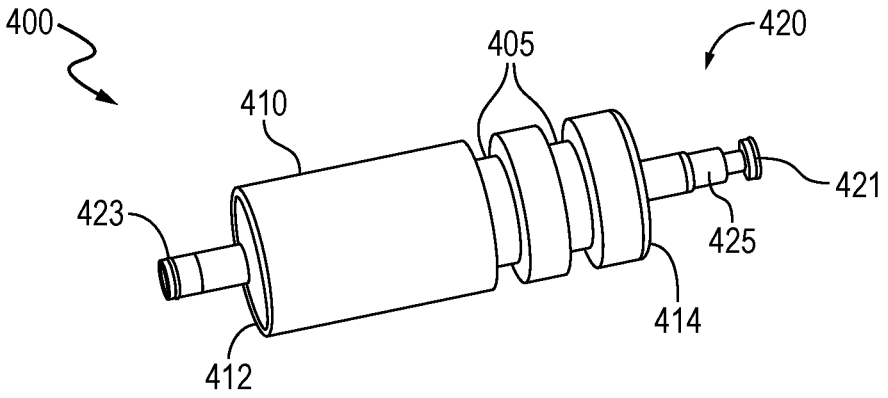
FIG. 4A is a perspective view of a bulkhead assembly of the present invention, in one embodiment.
Figure 4B:
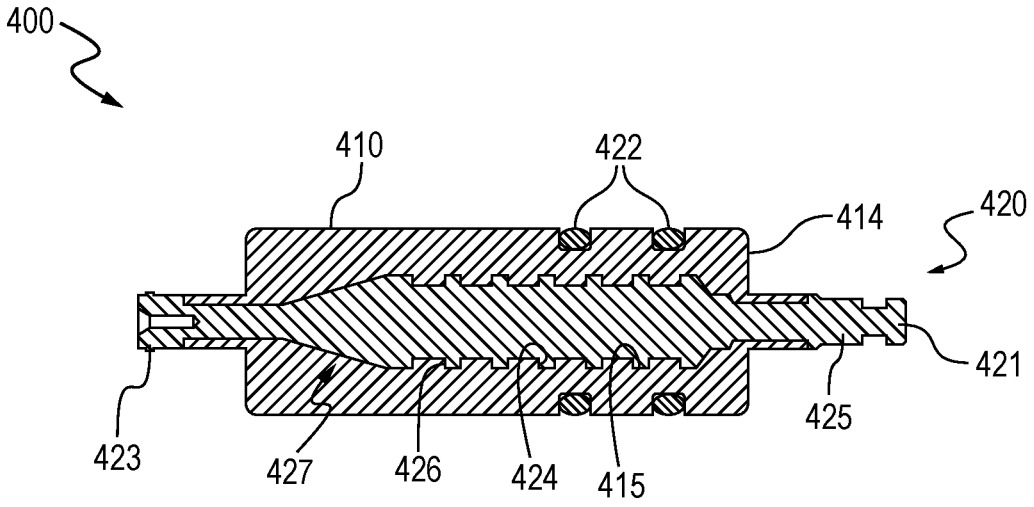
FIG. 4B is a cross-sectional view of the bulkhead assembly of FIG. 4A. O-rings have been added to the body of the bulkhead.

FIG. 4A is a perspective view of a bulkhead assembly 400 of the present invention, in one embodiment. FIG. 4B is a cross-sectional view of the bulkhead assembly 400 of FIG. 4A. The bulkhead assembly 400 is designed to transmit current to a downhole tool. Preferably, the downhole tool is a perforating gun, such as the perforating gun 208 of FIG. 2. Alternatively, the downhole tool may be a logging tool.

The bulkhead assembly 400 first comprises a bulkhead body 410. The bulkhead body 410 defines a somewhat tubular device. In this respect, the bulkhead body 410 includes an outer diameter and an inner diameter.

The bulkhead body 410 has a first end 412, a second end 414, and a bore (or cavity) 415 extending there between. The bore 415 represents the inner diameter referred to above, and is configured to serve as a receptacle. Preferably, the bulkhead body 410 is fabricated from a non-conductive material such as plastic (a poly-carbonate) or nylon.

The bulkhead assembly 400 further comprises an electrical contact pin 420. The contact pin 420 comprises a shaft 425 having a first end 423 and a second end 421. The shaft 425 is fabricated substantially from brass or other conductive metal. The shaft 425 extends through the bore 415 of the bulkhead body 410, and frictionally resides within the bore 415. The contact pin 420 transmits current from the first end 423 to the second end 421 in response to signals sent by the e-line 330.

The second end 421 of the shaft 425 defines a contact head. The contact head 421 is configured to transmit electrical signals to an adjoining perforating gun. This is done by sending the signals through a terminal to a communication wire associated with the adjoining, or downstream perforation gun.

Of interest, the shaft 425 of the electrical contact pin 420 comprises a plurality of grooves 426. At the same time, the receptacle (as a part of the bore 415) comprises a profile 424 for mating with the plurality of grooves 426. This grooved, interlocking arrangement increases shear strength of the bulkhead assembly 400, and particularly the bulkhead body 410.

In one embodiment, the plurality of grooves 426 comprises at least three grooves 426, and preferably five or even six grooves 426 equi-distantly spaced along the shaft 422.

Preferably, the first end 423 of the electrical contact pin 420 is in electrical communication with a wire (such as wire 240 of FIG. 2) within a wellbore. The wire 240 transmits electrical signals from an operator at the surface. At the same time, the shaft 425 comprises a conical portion 427 proximate the first end 423 that frictionally fits into a mating conical profile (that is, the bore 415) for the receptacle. This further enhances shear strength of the bulkhead assembly 400.

Figure 5A:
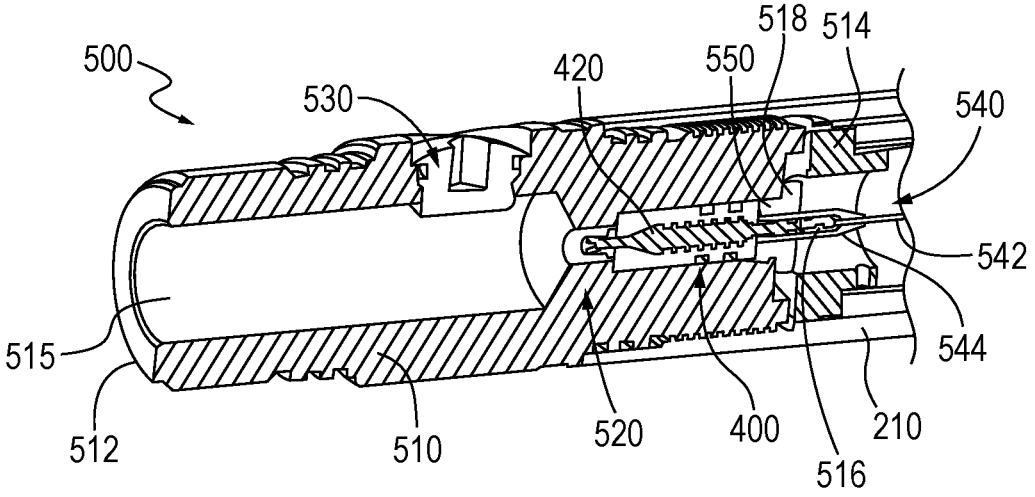
FIG. 5A is a cross-sectional view of the bulkhead assembly of FIG. 4 having been placed within a tandem sub. Visible in this view is a novel electrical connection with the contact pin of the bulkhead assembly.

FIG. 5A is a cross-sectional view of a tandem sub 500. The tandem sub 500 comprises a tubular body 510 having a first end 512 and a second end 514. The opposing ends 512, 514 define male connectors and are configured to threadedly connect with a female end of a perforating gun (as shown at 210 in FIG. 2).

The tandem sub 500 includes a receptacle 520. The receptacle 520 is dimensioned to closely receive the bulkhead 400 of FIGS. 4A and 4B. An optional wire entry port 530 is provided along the body 510 of the tandem sub 500.

Figure 14:
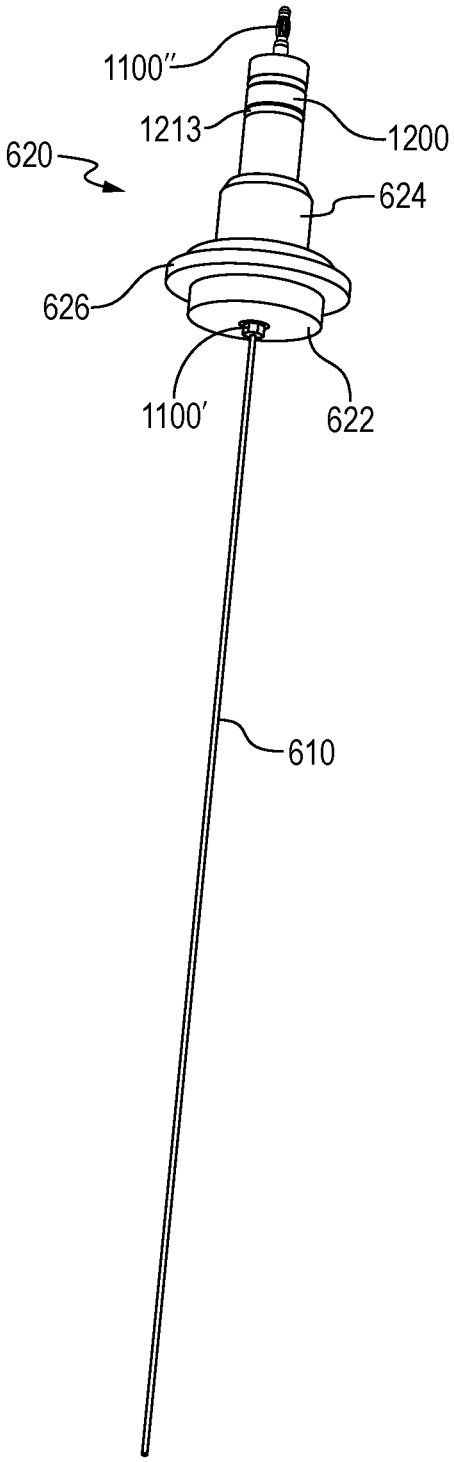
FIG. 14 is a perspective view of a portion of a perforating gun assembly. A top end plate is shown, with a contact pin and supporting bulkhead extending up from the top plate. At the same time, a communications line extends down from the top plate.

The tandem sub 500 of FIG. 5A also includes a novel electrical communication system 540. The communication system 500 is designed to place a communication wire 542 in electrical communication with the contact head 421 of the electrical contact pin 420. For reference, a communication wire is also shown in FIG. 14, at 610.

The electrical communication system 500 comprises a rubber boot 544. The rubber boot 544 extends from the communication wire 542 down over the contact head 421. A barrel connector terminal 516 is provided between the communication wire 542 and the contact head 421. The barrel connector terminal 516 resides within the rubber boot 544.

Of interest, the rubber boot 544 has a flange 518 that is captured under a standard castle nut 550 of the tandem sub 500. Together with the castle nut 550, the rubber boot 544 helps hold the communication wire 542 in place with the connector terminal 516, with or without soldering. The rubber boot 544 also provides strain relief to the communication wire 542 and guides the wire 542 into the tandem sub 500 during assembly.

Figure 5B:
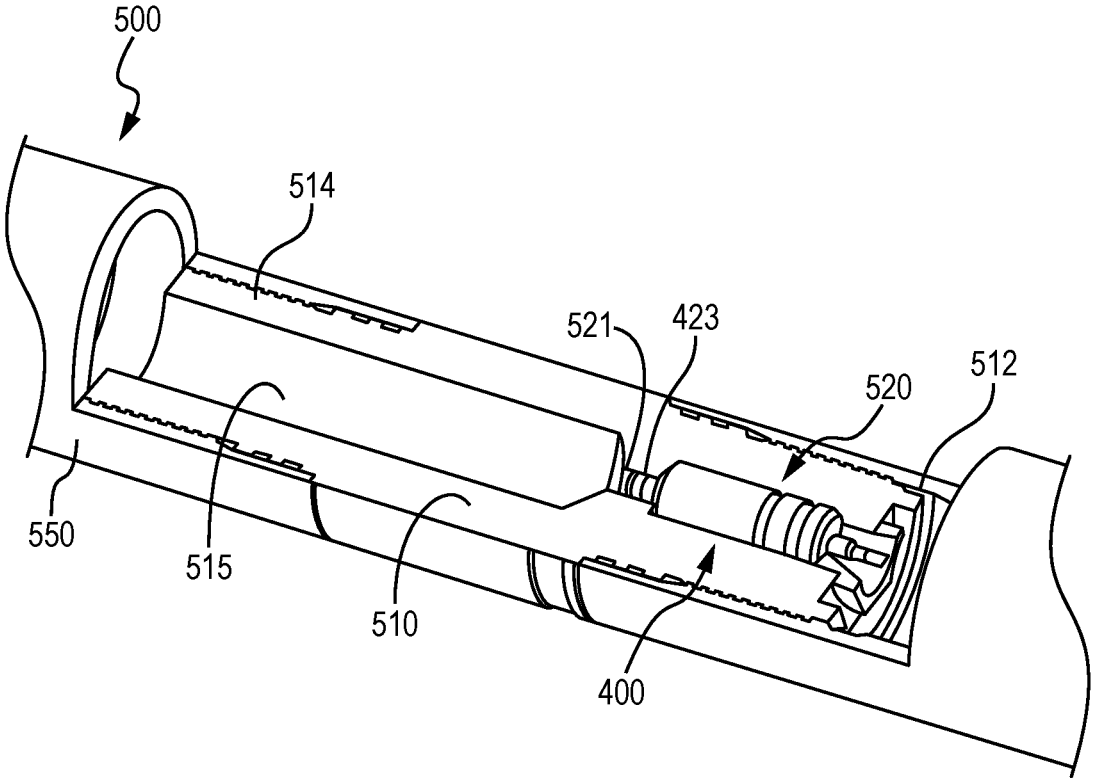
FIG. 5B is a cut-away view of the tandem sub of FIG. 5A. Here, the bulkhead is shown in perspective.

FIG. 5B is a cut-away view of the tandem sub 500 of FIG. 5A. Here, the bulkhead 400 is shown residing in the bore of the tandem sub 500, in perspective.

Figure 6:
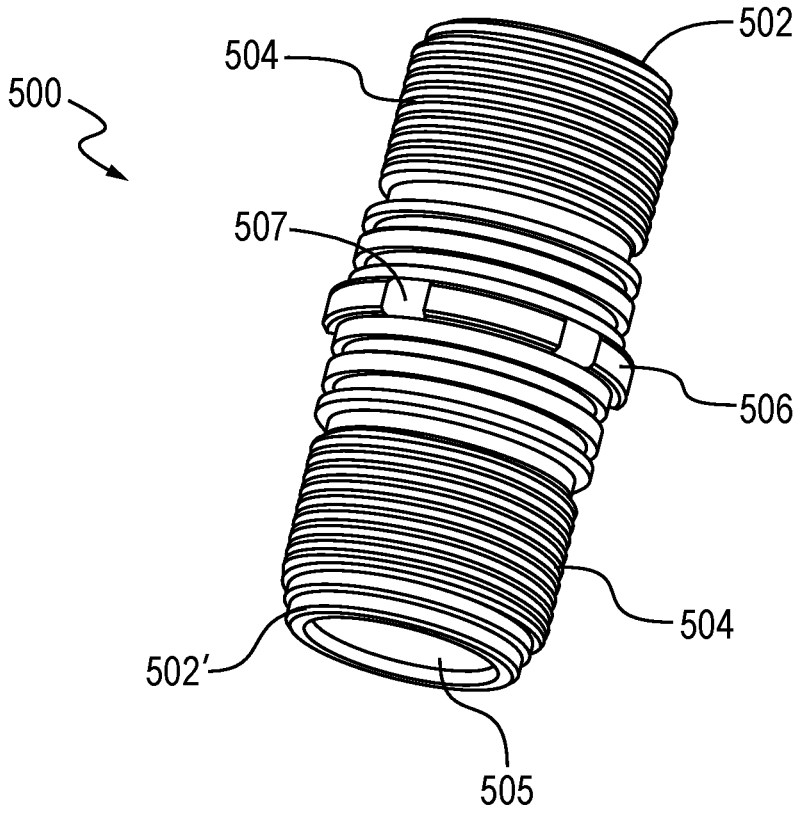
FIG. 6 is a perspective view of a tandem sub of the present invention, in one embodiment.

FIG. 6 is a perspective view of the tandem sub 500. The tandem sub 500 defines a short tubular body having a first end 502 and a second opposing end 502'. The tandem sub 500 may be, for example, 1.00 inches to 5.0 inches in length, with the two ends 502, 502' being mirror images of one another. Note that in FIG. 6, the optional wire entry port 530 has been removed from the tandem sub 500.

The tandem sub 500 includes externally machined threads 504. The threads 504 are male threads dimensioned to mate with female threaded ends of a gun barrel, such as gun barrels 212 of FIG. 2 The tandem sub 500 is preferably dimensioned in accordance with standard 3⅛" gun components. This allows the tandem sub 500 to be threadedly connected in series with perforating guns from any American vendor, e.g., Geo-Dynamics® and Titan®.

Intermediate the length of the tandem sub 500 and between the threads 504 is a shoulder 506. The shoulder 506 serves as a stop member as the tandem sub 500 is screwed into the end of a gun barrel 212. Optionally, grooves 507 are formed equi-radially around the shoulder 506. The grooves 507 cooperate with a tool (not shown) used for applying a rotational force to the tandem sub 500 without harming the rugosity of the shoulder 506.

The tandem sub 500 includes a central chamber 515. The central chamber 515 (indicated in FIG. 5B) is dimensioned to hold an addressable switch 660 and a signal transmission pin 720' (not shown in FIG. 9 but visible in FIG. 8). The addressable switch 660 is part of an electronic detonation assembly (shown partially in FIG. 9 at 600) that receives detonation signals from the electrical contact pin 420 upstream).

Returning to FIGS. 5A and 5B, central chamber 515 ends at a conduit 521. The conduit 521 receives an end 423 of the contact pin 420. Opposite the conduit 521 from the central chamber 515 is the receptacle 520. As noted above, the receptacle 520 closely receives the bulkhead assembly 400.

Figure 7:
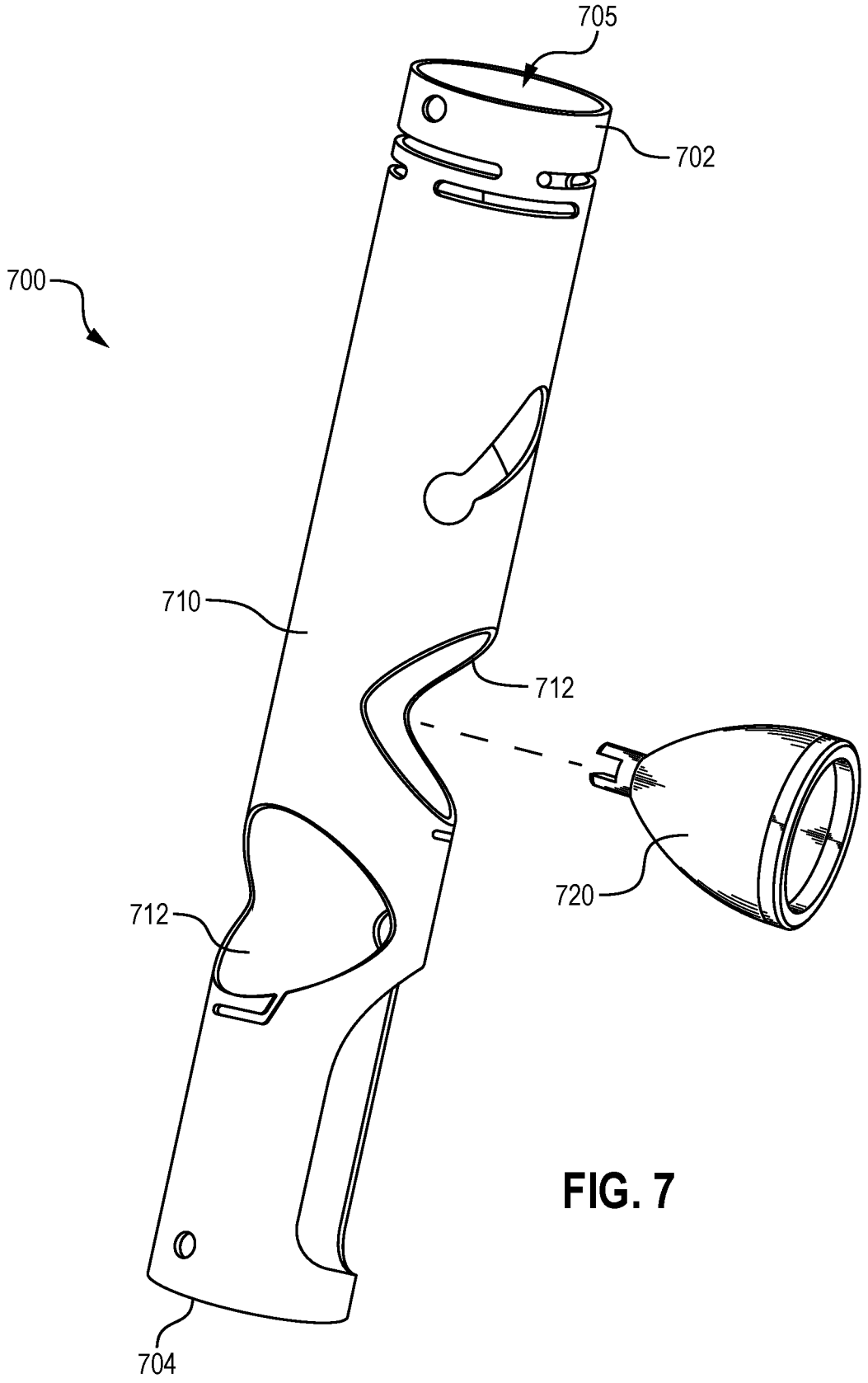
FIG. 7 is a perspective view of an illustrative carrier tube for a perforating gun. A shaped-charge is shown in exploded-apart relation with an opening of the carrier tube.

FIG. 7 is a perspective view of an illustrative carrier tube 700 for a perforating gun 210. The carrier tube 700 defines an elongated tubular body 710 having a first end 702 and a second opposing end 704. The carrier tube 700 has an inner bore 705 dimensioned to receive charges. A single illustrative charge is shown at 720 in exploded-apart relation.

Openings 712 are provided for receiving the charges 720 and enabling the charges to penetrate a surrounding casing string 150 upon detonation.

Figure 8:
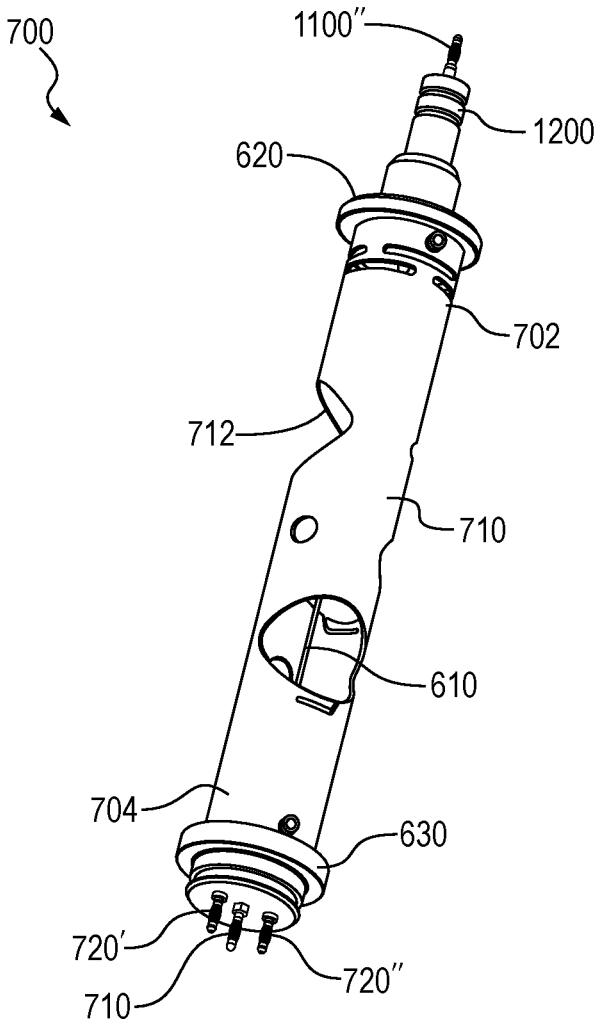
FIG. 8 is a perspective view of the carrier tube of FIG. 7. The carrier tube has received a top end plate and a bottom end plate. An electric line is shown extending through the carrier tube, through the bottom end plate, and down from the tool.

FIG. 8 is a perspective view of the carrier tube 700 (without shaped charges). The carrier tube 700 has received a top end plate 620 and a bottom end plate 630. The end plates 620, 630 have mechanically enclosed top 702 and bottom 704 ends of the carrier tube 700, respectively. The end plates 620, 630 help center the carrier tube 700 and its charges within an outer gun barrel (not shown in FIG. 8 but shown at 212 in FIG. 2). Of interest, a central flange 636 receives the lowermost end 704 of the gun barrel housing 700.

An electronic detonator and a detonating cord (not shown) reside inside the carrier tube 700. The carrier tube 700 and charges 720, together with the gun barrel 212, form a perforating gun 210, while the perforating gun along with the end plates 620, 630, the detonating cord and the detonator form a perforating gun assembly. In some cases the term "perforating gun assembly" is used in the industry to also include an adjacent tandem sub and electronics, and possibly a series of perforating guns 210 such as in FIG. 2.

Figure 11:
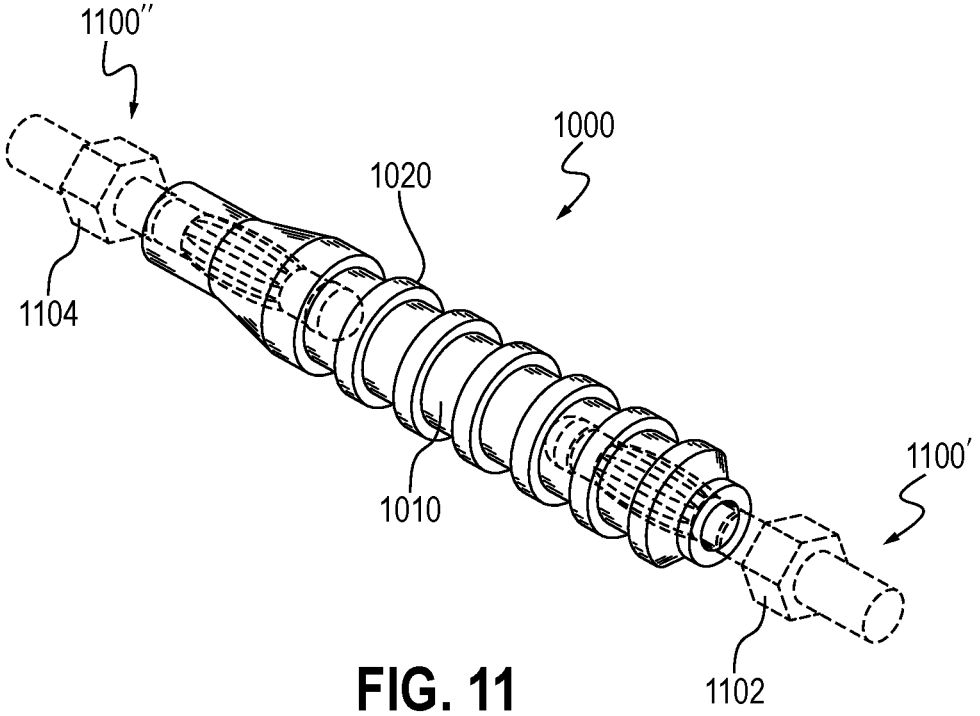
FIG. 11 is a third perspective view of the contact pin of FIG. 10A. Here, signal transmission pins are shown having been inserted into the opposing female ends of the contact pin. The signal transmission pins are seen in phantom.

A communications line 610 is shown extending through the carrier tube 700, and to the bottom end plate 630. Three separate pins are shown extending down from the bottom end plate 630. These represent a signal transmission pin 720', a detonator pin 720", and a ground pin 710. The functions of these pins are described more fully in U.S. Ser. No. 16/996,692 filed Aug. 18, 2020 and incorporated herein by reference in its entirety. The communications line 610 extends down from communication wire 542 of FIG. 5A, or signal transmission pin 1100' of FIG. 11, depending on the arrangement of the perforating gun assembly.

Figure 9:
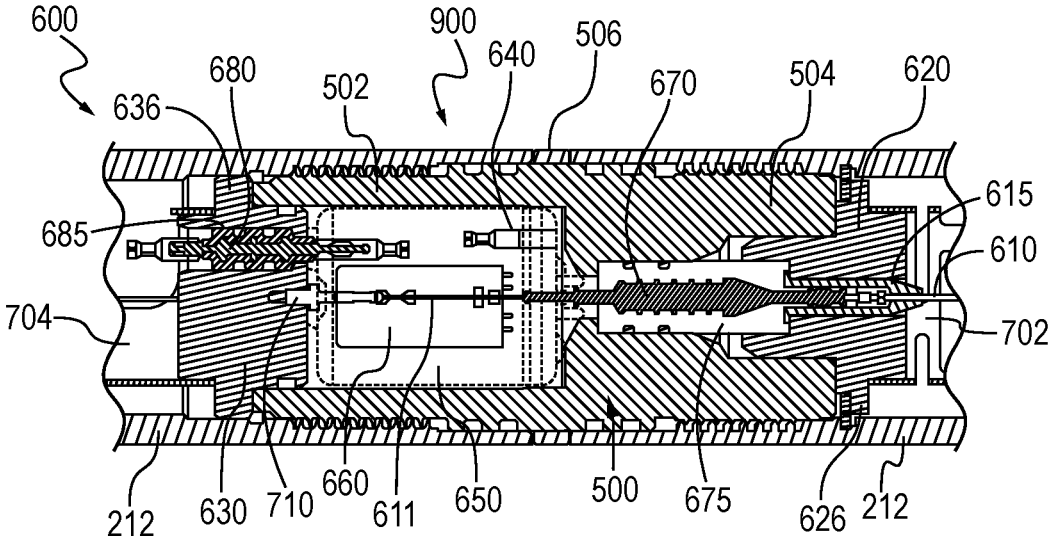
FIG. 9 is a side, cross-sectional view of an explosive initiation assembly having a bulkhead assembly therein. The explosive initiation assembly is threadedly connected at opposing ends to gun barrel housings, forming a perforating gun assembly.

FIG. 9 is a side, cross-sectional view of an explosive initiation assembly 900 as may be used with the contact pin carrier tube 700. The explosive initiation assembly 900 is threadedly connected at opposing ends to gun barrel housings 212, forming a perforating gun assembly 600 in an alternate embodiment from that of FIG. 5A.

The explosive initiation assembly 900 first includes a switch housing 650. The switch housing 650 resides within a bore of the tandem sub 500.

The explosive initiation assembly 900 also includes an addressable switch 660. The addressable switch 660 resides within the switch housing 650. The addressable switch 660 receives signals from the surface as sent by an operator, through pin 720'. The switch 660 then filter those signals to identify (or to look for) an activation signal. If an activation signal is identified, then a signal is separately sent through a detonator pin 720" (which is the same as pin 680) for detonation of charges in an adjacent (typically upstream) perforating gun 210. Note that detonator pin 720" is never in electrical communication with either the signal transmission pin 720' or the contact pin 420 (or, in another embodiment, pin 620 shown in FIG. 9.)

In this arrangement, the tandem sub 500 and its switch housing 650 reside between a bottom plate 630 and a top end plate 620. Flange members 636, 626 associated with the bottom end plate 630 and the top end plate 620, respectively, abut opposing ends of the tandem sub 500. Beneficially, the end plates 630, 620 mechanically seal the tandem sub 500, protecting, the addressable switch 660 from wellbore fluids and debris generated during detonation of the charges 520. Note that the bulkhead 410 and the contact pin 420 (or bulkhead 675 and contact pin 670 of FIG. 9) play no role in preventing a pressure wave from reaching the electronics or an upstream perforating gun.

Note also that neither the top end plate 620 nor the bottom end plate 630 is a so-called "tandem sub adapter." Indeed, neither the top end plate 620 nor the bottom end plate 630 even resides within the tandem sub 500. Additional details concerning the top end plate 620 and the bottom end plate 630 are disclosed in U.S. Ser. No. 16/996,692 incorporated herein by reference in its entirety.

The explosive initiation assembly 900 also includes a contact pin 670. The contact pin 670 resides within a non-conductive bulkhead 675. A downstream, or first end, of the contact pin 670 extends into the top end plate 620 while an upstream, or second end, of the contact pin 670 extends into the switch housing 650. Note that neither signal transmission pin 720' nor contact pin 670 is ever in electrical communication with the upstream detonator.

It can be seen that the communication line 610 is connected to the downstream end of the contact pin 670. The communication line 610 is protected along the top end plate 620 by means of a tubular insulator 615.

The explosive initiation assembly 900 further includes a detonation pin 680. Note that detonation pin 680 is the same as detonator pin 720' shown in FIG. 8. The detonation pin 680 also resides within a non-conductive bulkhead 685. Indeed, each of transmission pins 720' and 720" is encased in a bulkhead 685 (although pin 720' is not visible in the cut of FIG. 9). A proximal end of the detonation pin 680 resides within an adjacent carrier tube 700, while a distal end extends into the switch housing 650.

It is proposed herein to modify the contact pin 670 and the profile of the bulkhead 675 to provide more secure connections with the signal transmission pins and communication line 610. Specifically, it is desirable to provide improved insulation to protect connections at either end of the contact pin 670. This way there is less chance of an electrical short, causing electrical communication failure along a perforating gun too string. This is done by providing a contact pin 1000 that has opposing female ends, wherein each end receives a signal transmission pin that is preferably in the form of a banana clip. The banana clips 1100 are inserted into respective opposing ends of a bulkhead 1200, thereby fully protecting the electrical connections within the bulkhead body.

Figure 10A:
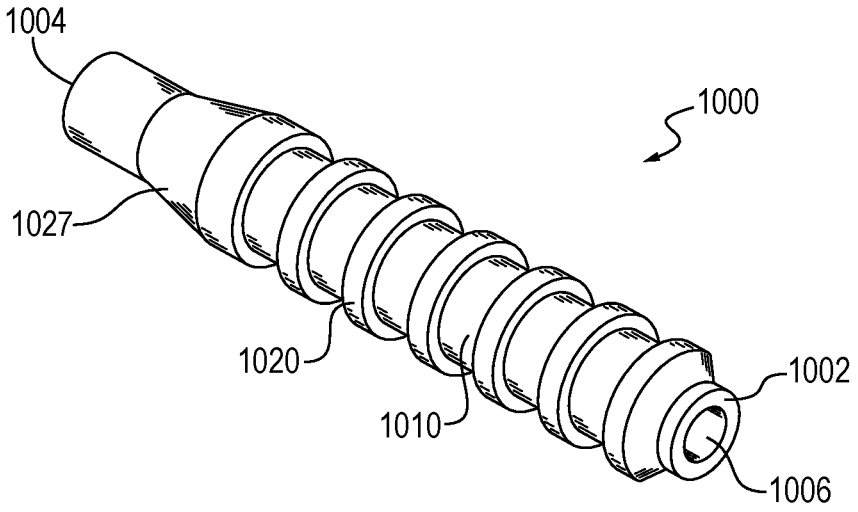
FIG. 10A is first perspective view of a contact pin that may be placed in the bulkhead of FIG. 9, but in an alternate embodiment.
Figure 10B:
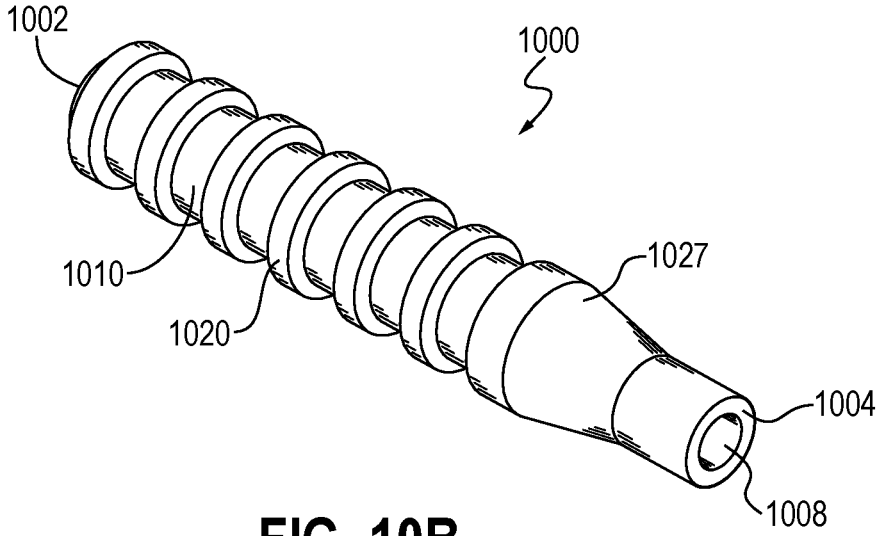
FIG. 10B is a second perspective view of the contact pin of FIG. 10A, shown from an end that is opposite the end shown in FIG. 10A.

FIG. 10A is a first perspective view of a contact pin 1000 in an alternate embodiment, shown from an end 1002. FIG. 10B is a second perspective view of the contact pin 1000 of FIG. 10A, shown from an end 1004 that is opposite the end 1002. The contact pin 1000 will be presented with reference to FIGS. 10A and 108 together.

The contact pin 1000 defines an elongated body 1010. In accordance with the direction of current through the body 1010, end 1004 is an upstream pin connector while end 1002 is a downstream pin connector, with current flowing from upstream to downstream. Of interest, and as shown best in FIG. 13B, the pin connector ends 1002, 1004 do not extend out from a bulkhead.

The body 1010 of the contact pin 1000 includes a plurality of shoulders, or upsets 1020. The shoulders 1020 are spaced equi-distantly along a portion of the length of the elongated body 1010. In the illustrative arrangement of FIGS. 10A and 10B, seven upsets 1020 are provided.

Figure 12B:
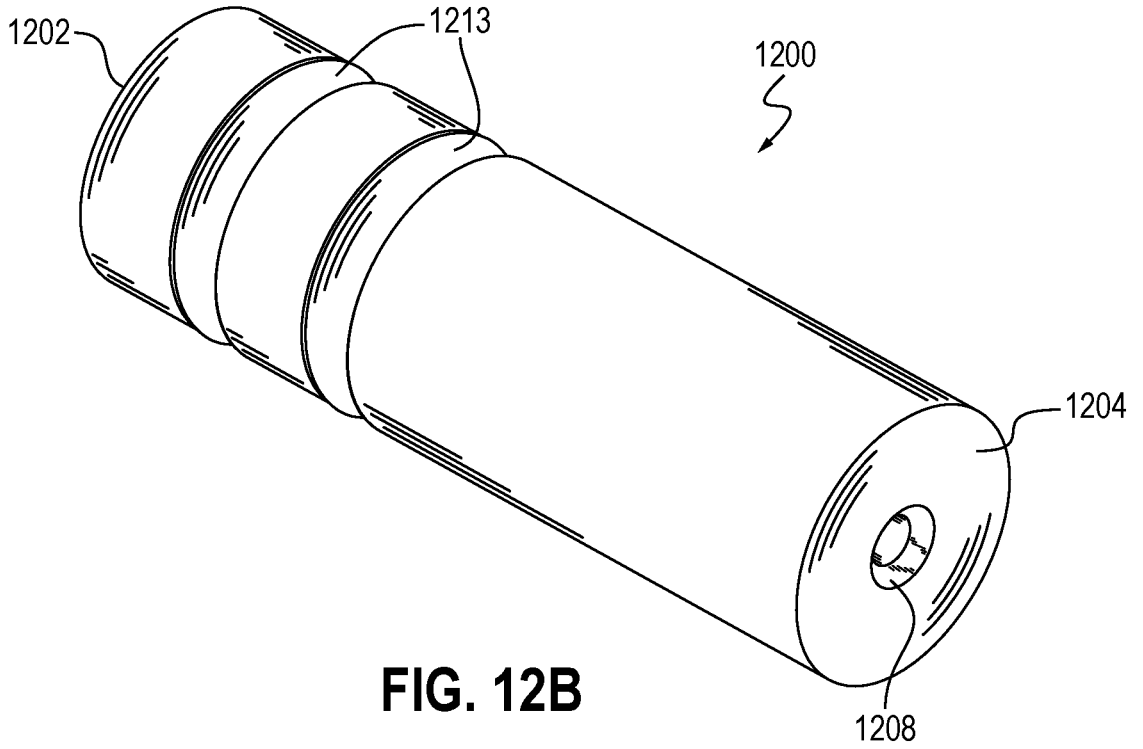
FIG. 12B is a second perspective view of the bulkhead of FIG. 12A, shown from an end that is opposite the end of FIG. 12A.
Figure 13A:
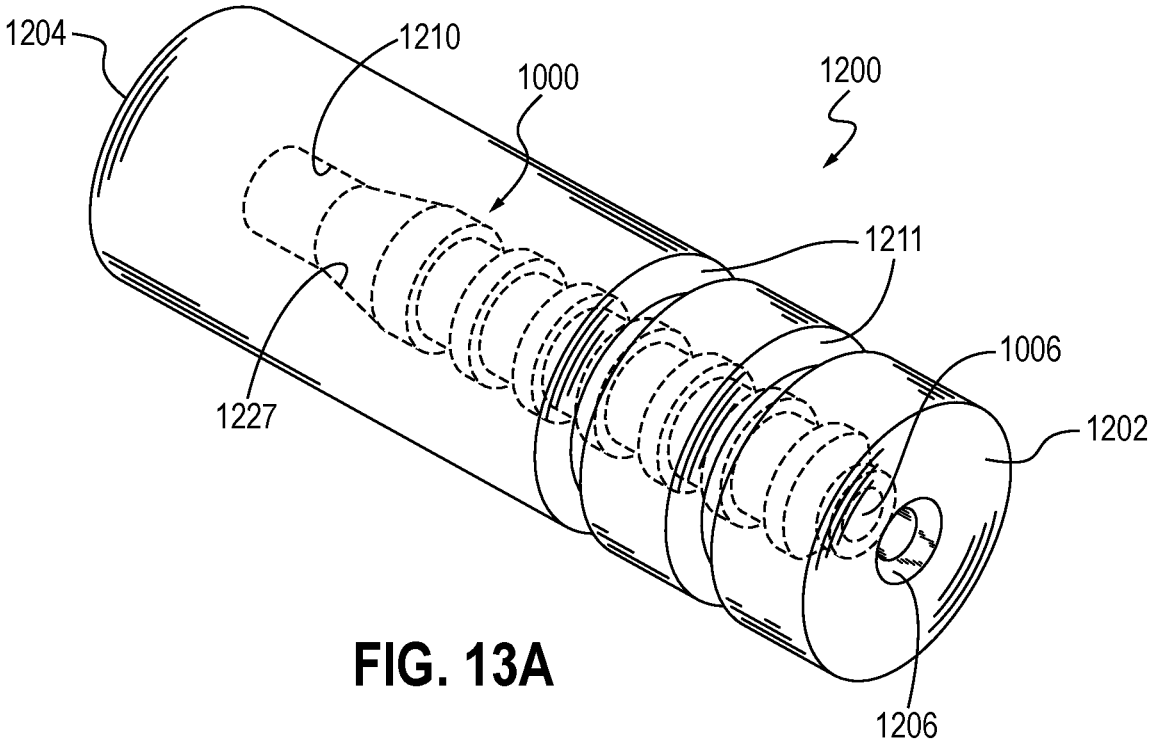
FIG. 13A is a third perspective view of the bulkhead of FIG. 12A. Here, a contact pin is shown residing within a bore of the bulkhead, in phantom.

The downstream end 1202 of the bulkhead 1200 provides for an opening 1206 (seen in FIG. 13A). Similarly, the upstream end 1204 of the bulkhead 1200 provides for an opening 1208 (seen in FIG. 12B). Each opening 1206, 1208 preferably has a circular profile forming a cylindrical bore that leads into the respective openings 1006, 1008 of the contact pin 1100. The openings 1206, 1208 in the bulkhead body 1205 are dimensioned to receive the signal transmission pins 1100', 1100", as shown in FIG. 13B.

Figure 12A:
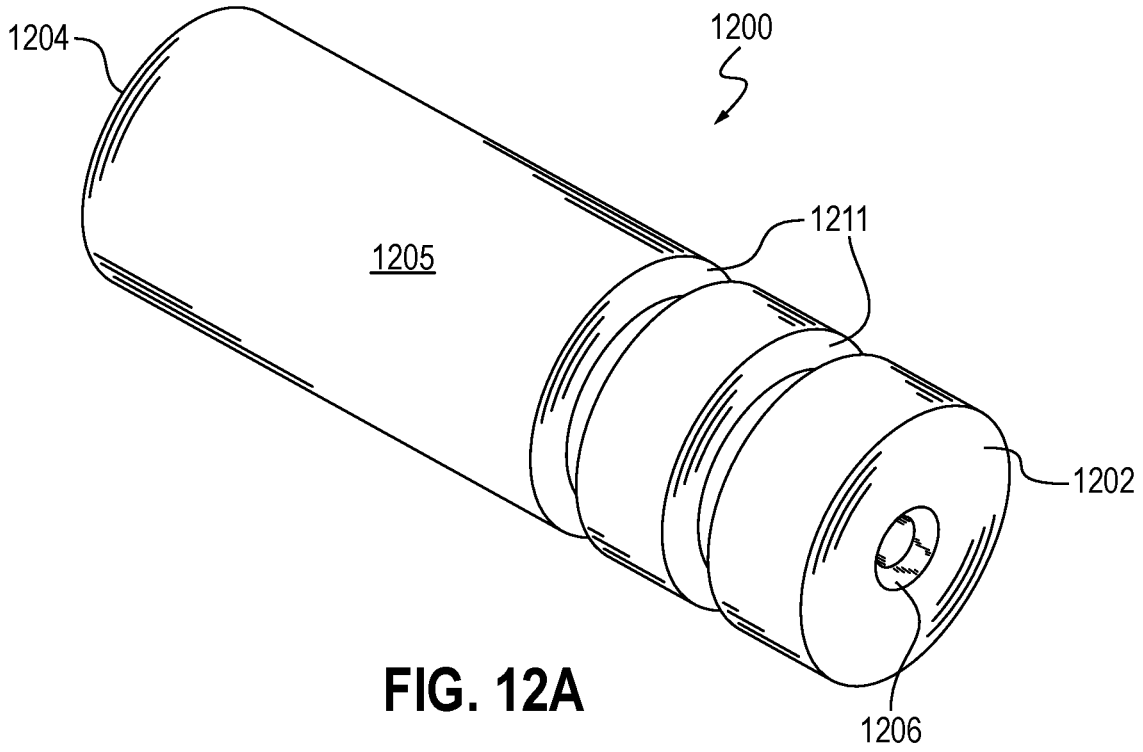
FIG. 12A is a first perspective view of a bulkhead for receiving the contact pin of FIG. 10A, shown from an end.

FIG. 13A is a third perspective view of the bulkhead 1200 of FIGS. 12A and 12B. Here, the contact pin 1000 is shown residing within a bore 1210 of the bulkhead 1200. It can be seen that opening 1206 is aligned with opening 1006 for receiving h signal transmission pin 1100'. It is understood that opening 1208 is aligned with opening 1008 for receiving the signal transmission pin 1100" (as shown in FIG. 13B).

Figure 13B:
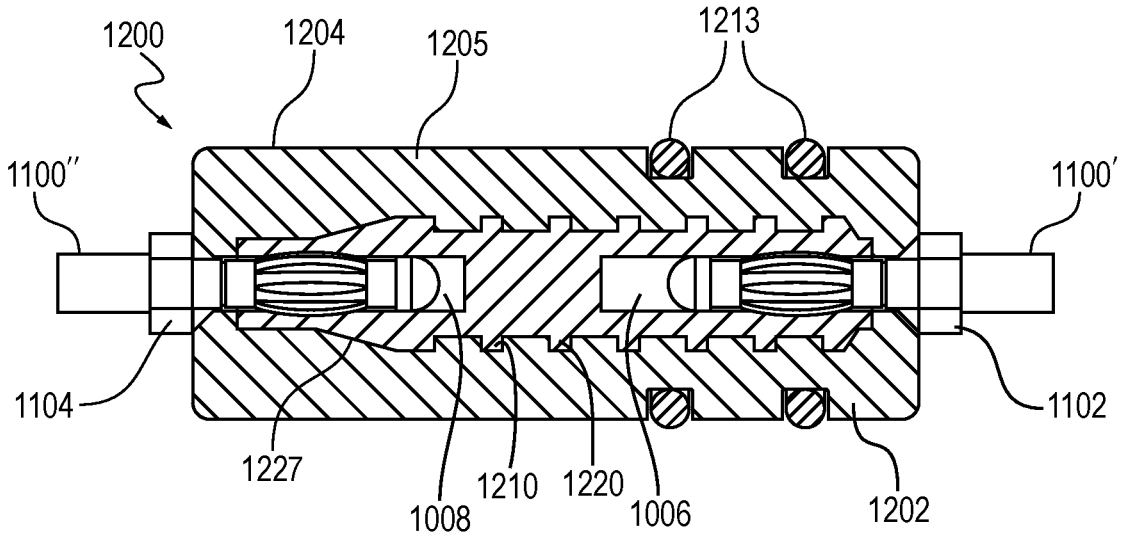
FIG. 13B is a cross-sectional view of the bulkhead of FIGS. 12A and 12B. The contact pin is shown residing within the bore of the bulkhead.

FIG. 13B is a cross-sectional view of the bulkhead 1200 of FIGS. 12A and 12B. The contact pin 1000 is shown residing within the bore 1210 of the bulkhead 1200. It is also noted that signal transmission pins 1100', 1100" have been inserted into the opposing ends 1206, 1208 of the bulkhead 1200. Each pin 1100 extends into an opening 1006, 1008 of the corresponding end 1002, 1004 of the contact pin 1000. Flange 1102 serves as a stop member as signal transmission pin 1100' is inserted into opening 1006. Likewise, flange 1104 serves as a stop member as signal transmission pin 1100" is inserted into opening 1008.

FIG. 12A is a first perspective view of a bulkhead 1200 for receiving the contact pin 1000 of FIGS. 10A and 10B. The bulkhead 1200 is shown from a downstream, or first end 1202. FIG. 12B is a second perspective view of the bulkhead 1200 of FIG. 12A, shown from an upstream, or second end 1204 opposite the end 1202.

The bulkhead 1200 defines an elongated body 1205 with a generally circular outer diameter. In the illustrative arrangement of FIGS. 12A and 12B, a pair of indentations 1211 is preserved for receiving o-rings. The o-rings are shown at 1213 in FIG. 12B.

The downstream end 1202 of the bulkhead 1200 provides for an opening 1206. Similarly, the upstream end 1204 of the bulkhead 1200 provides for an opening 1208. Each opening 1206, 1208 preferably has a circular profile forming a cylindrical bore that leads into the respective openings 1106, 1108 of the contact pin 1100. The opening 1206, 1208 are dimensioned to receive the signal transmission pins 1100, as shown in FIG. 13B.

FIG. 13A is a third perspective view of the bulkhead 1200 of FIGS. 12A and 12B. Here, the contact pin 1000 is shown residing within a bore 1210 of the bulkhead 1200. It can be seen that opening 1206 is aligned with opening 1106 for receiving a signal transmission pin 1100.

FIG. 13B is a cross-sectional view of the bulkhead 1200 of FIGS. 12A and 12B. The contact pin 1000 is shown residing within the bore 1210 of the bulkhead 1200. It is also noted that signal transmission pins 1100', 1100" have been inserted into the opposing ends 1206, 1208 of the bulkhead 1200. Each pin 1100 extends into an opening 1106, 1108 of the corresponding end 1002, 1004 of the contact pin 1000.

The result of the bulk-head assembly of FIG. 13B is that an improved contact pin and bulk head are provided. The contact pin includes a female-x-female arrangement for receiving respective signal transmission pins. Each of the signal transmission pins serves as a male connector. Beneficially, the male connectors remain reusable even if the bulkhead is destroyed during run-in and gun detonation. This arrangement also eliminates the risk of damaging the "pins" that would otherwise extend outward from a bulkhead when installing into a sub.

Finally, FIG. 14 is a perspective view of a portion of a perforating gun assembly 600. The view of FIG. 14 is the same as that if FIG. 8, except the gun carrier tube 700 has been removed for illustrative purposes.

In FIG. 14, the top end plate 620 is shown, which is component of the perforating gun assembly 600. The top end plate 620 has a proximal end 622 and a distal end 624. Intermediate the proximal 622 and distal 624 ends is a flange 626. As indicated in FIG. 9, a downstream end of the tandem sub 500 shoulders out against the flange 626.

The proximal end 622 of the top end plate 620 comprises a threaded opening (not visible. The threaded opening is configured to receive a bolt or pin (not shown) that radially fixes the top end plate 620 to the top of the carrier tube 510. Thus, the top end plate 620 generally abuts a gun barrel housing (not shown) that extends down below the top end plate 620 and houses shaped charges. The end plate 620 sits up hole from, or at the top of, a perforating gun. It is understood that there is also a bottom end plate 630 (shown in FIGS. 8 and 9) at the down hole end of the perforating gun.

Upstream from the top end plate 620 is the bulkhead 1200. Signal transmission pins 1100', 1100" are inserted into opposing ends 1202, 1204 of the bulkhead 1200. At the same time, a communication line 610 extends down from the lower signal transmission pin 1100'. It is understood that either or both of the signal transmission pins 1100', 1100" could be arranged to be inserted completely into respective openings 1006, 1008 of the contact pin 1000, meaning that the connections do not extend beyond wither of the first end or the second end of the bulkhead. In this instance, the communication wire 542 (or 610) would extend into female opening 1006. Alternatively or in addition, a wire 611 would extend into female opening 1008. A clip may be used to releasably connect wires 610, 611 into the openings 1006, 1008 of the respective conductive ends 1002, 1004.

Further, variations of the tool and of methods for using the tool within a wellbore may fall within the spirit of the claims, below. It will be appreciated that the inventions are susceptible to other modifications, variations and changes without departing from the spirit thereof.

We claim:

1. A bulkhead assembly for transmitting current to a downhole tool, comprising:

a tubular bulkhead body having a first end, a second end and a bore extending there between;

an electrical contact pin having an elongated shaft residing entirely within the bore of the bulkhead body, with the shaft having a first end and a second end, and wherein:

the first end of the contact pin defines an opening configured to receive a first signal transmission pin, the first end of the contact pin is configured to be in electrical communication with a communications wire that extends downstream from the bulkhead assembly, to transmit electrical signals to an adjoining downhole tool, the second end of the contact pin also defines an opening, and is configured to receive a second signal transmission pin, the second end of the contact pin is configured to be in electrical communication with an electric line within a wellbore from upstream of the bulkhead assembly, by means of the second signal transmission pin, the electric line transmits electrical signals to the second signal transmission pin from a surface, the contact pin is fabricated from an electrically conductive material for transmitting electrical energy from the second end down to the first end, and the shaft of the electrical contact pin comprises a plurality of shoulders, while the bore of the bulkhead body comprises a profile for mating with the plurality of shoulders for increasing shear strength of the bulkhead assembly.

2. The bulkhead assembly of claim 1, wherein:

the downhole tool is (i) a perforating gun, or (ii) a logging tool.

3. The bulkhead assembly of claim 2, wherein:

the downhole tool is a perforating gun;

the bulkhead body resides within a tandem sub; and the bulkhead body is fabricated from a non-conductive material.

4. The bulkhead assembly of claim 3, wherein the non-conductive material comprises a poly-carbonate material or nylon.

5. The bulkhead assembly of claim 3, wherein the first signal transmission pin resides entirely within the first end of the contact pin, the second signal transmission pin resides entirely within the second end of the contact pin, or both.

6. The bulkhead assembly of claim 3, wherein:

the electrical contact pin is fabricated substantially from brass; and the first signal transmission pin and the second signal transmission pin each represent a clip.

7. The bulkhead assembly of claim 6, wherein the plurality of shoulders comprises at least three shoulders equi-distantly spaced along the bulkhead body between the first end and the second end of the contact pin.

8. The bulkhead assembly of claim 6, wherein the shaft further comprises a frusto-conical portion proximate the first end of the shaft that frictionally fits into a mating conical profile of the bore of the bulkhead body.

9. A tandem sub for a perforating gun assembly, comprising:

a first end comprising a male connector, the first end being threadedly connected to a gun barrel housing associated with a first perforating gun;

a second opposing end also comprising a male connector and being threadedly connected to a gun barrel housing associated with a second perforating gun;

a bore extending from the first end to the second end, with the bore comprising a receptacle, and with the receptacle being dimensioned to closely receive a bulkhead, wherein the bulkhead comprises:

a tubular body having a first end, a second end and a bore extending there between;

an electrical contact pin having an elongated shaft residing entirely within the bore of the bulkhead body, with the shaft having a first end and a second end, and wherein the first end of the contact pin defines an opening configured to receive a first signal transmission pin, the first end of the contact pin is configured to be in electrical communication with a communications wire that extends downstream from the bulkhead assembly, to transmit electrical signals to an adjoining downhole tool, the second end of the contact pin also defines an opening, and is configured to receive a second signal transmission pin, the second end of the contact pin is configured to be in electrical communication with an electric line within a wellbore from upstream of the bulkhead assembly, by means of the second signal transmission pin, the electric line transmits electrical signals to the second signal transmission pin from a surface, the contact pin is fabricated from an electrically conductive material for transmitting current from the second end down to the first end, the shaft of the contact pin comprises a plurality of shoulders, while the bore of the bulkhead body comprises a profile for mating with the plurality of shoulders for increasing shear strength of the bulkhead assembly, and the shaft further comprises a frusto-conical portion proximate the first end of the shaft that frictionally fits into a mating conical profile of the bore of the bulkhead body.

10. The tandem sub of claim 9, wherein the current represents detonation signals sent from a surface, down an electric line, and to the tandem sub.

11. The tandem sub of claim 9, wherein:

the electrical contact pin is fabricated substantially from brass;

the plurality of shoulders comprises at least three shoulders equi-distantly spaced along the body between the first end and the second end of the contact pin;

the bulkhead body is fabricated from a non-conductive material; and the first signal transmission pin and the second signal transmission pin each represent a clip.

12. The tandem sub of claim 11, wherein the first signal transmission pin resides entirely within the first end of the contact pin, the second signal transmission pin resides entirely within the second end of the contact pin, or both.

* * * * *